United States Patent [19]

Yamashita et al.

[11] Patent Number: 4,614,324

[45] Date of Patent: Sep. 30, 1986

[54] MOLD FOR PRODUCING CONCRETE PIPE

[75] Inventors: Kiichi Yamashita, Chiba; Junpei Tanizawa, Zushi; Takao Iwasaki, Kawasaki, all of Japan

[73] Assignees: Nippon Pressed Concrete Co., Ltd.; Nippon Zenith Pipe Co., Ltd., both of Tokyo, Japan

[21] Appl. No.: 606,208

[22] Filed: May 2, 1984

[30] Foreign Application Priority Data

| | | | |
|---|---|---|---|
| May 7, 1983 | [JP] | Japan | 58-79670 |
| May 7, 1983 | [JP] | Japan | 58-79671 |
| May 7, 1983 | [JP] | Japan | 58-79672 |
| Feb. 10, 1984 | [JP] | Japan | 59-23376 |

[51] Int. Cl.[4] ..... B28B 21/88

[52] U.S. Cl. ..... 249/11; 249/100; 249/137; 249/148; 249/152; 249/171; 249/178; 249/185; 249/186

[58] Field of Search ..... 249/11, 63, 137, 139, 249/144, 100, 101, 152, 171, 178, 180–182, 184–186, 148

[56] References Cited

U.S. PATENT DOCUMENTS

| | | | |
|---|---|---|---|
| 627,093 | 6/1899 | Bonta | 249/101 |
| 938,024 | 10/1909 | Sigler | 249/144 |
| 1,103,664 | 7/1914 | Draper | 249/100 |
| 1,126,131 | 1/1915 | Trayman | 249/148 |
| 1,236,410 | 8/1917 | Dougherty | 249/181 |
| 1,778,003 | 10/1930 | Tuerck | 249/137 |
| 1,927,256 | 9/1933 | Copeland et al. | 249/182 |
| 3,269,688 | 8/1966 | Hulicki | 249/185 |

*Primary Examiner*—Jay H. Woo
*Assistant Examiner*—James C. Housel
*Attorney, Agent, or Firm*—James H. Tilberry

[57] ABSTRACT

A mold is provided for use in the production of concrete pipe sections. The mold has an inner mold part including an arch-shaped mold member; a pair of substantially L-shaped side mold members each flexibly connected to an adjacent end of the arch-shaped mold member and extending along the side portions of the mold and with parts extending inwardly across the bottom portion of the mold, and a separable mold member detachably connected between the inwardly extending parts of the L-shaped side mold members. The parting of the mold from the product is accomplished by removing the separable mold member, and urging the L-shaped side mold members inwardly. Provided also is a mold for use in the production of mitred concrete pipe sections comprising an upper inclined pipe and a lower inclined pipe which are connected to each other at their mitred surfaces. A mold is also provided for producing concrete pipe elbows having partition plates adapted to produce elbows of various arcuate sizes.

2 Claims, 33 Drawing Figures

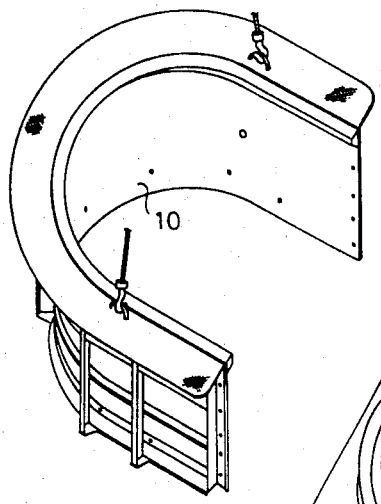
FIG. 8
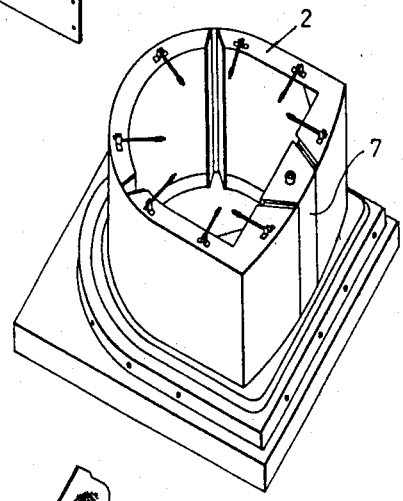
FIG. 9
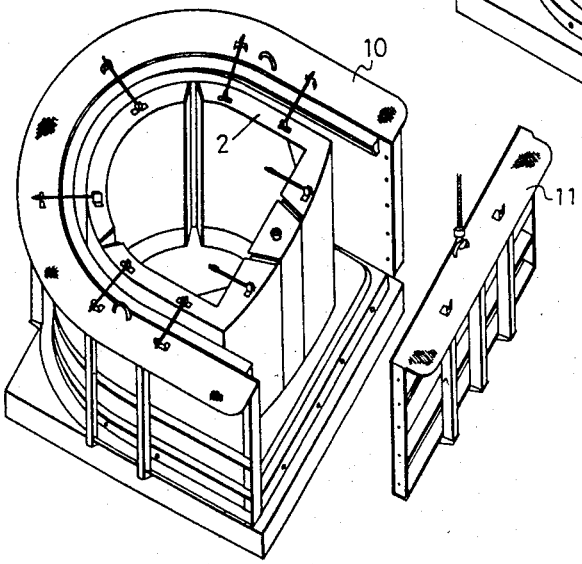

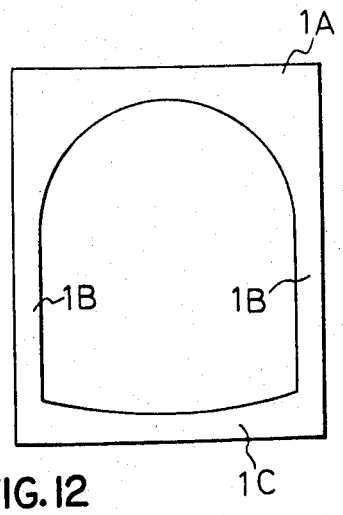
FIG. 12
FIG. 13
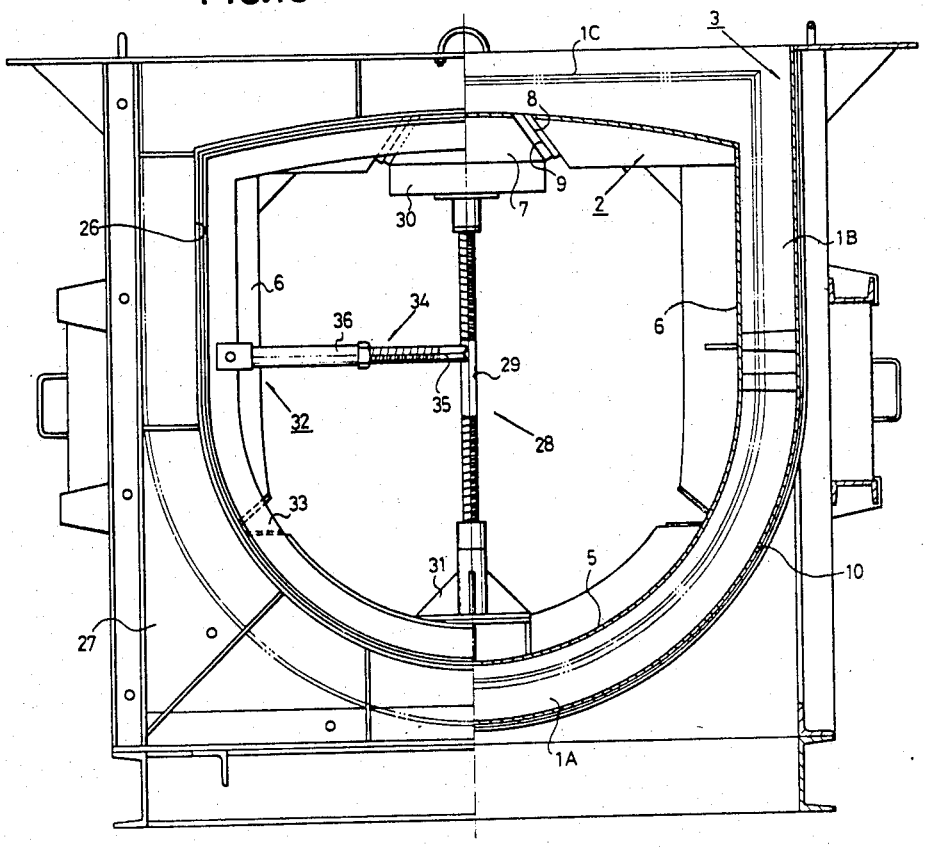

MOLD FOR PRODUCING CONCRETE PIPE

BACKGROUND OF THE INVENTION

1. Field of the Invention

The present invention relates to a mold for producing concrete pipes for use in constructing sewers, underpasses and other structures, particularly pipes of precast concrete having arch-shaped cross sections.

2. Description of the Prior Art

Generally, a precast concrete product having an arch-shaped internal cavity is produced from a mold which includes an inner mold part which determines the configuration of the internal cavity and an outer mold part which defines the outer configuration of the product. In order to facilitate the assembling of the mold, as well as the parting of the mold from the product, these mold parts are suitably divided into sections which are assembled together by, for example, bolts. However, a mere division of the mold parts does not facilitate the assembling and parting of the mold. In fact, the conventional mold of the kind described encounters a difficulty particularly in connection with the disassembling of the inner mold part.

SUMMARY OF THE INVENTION

Accordingly, an object of the invention is to provide a mold for producing a concrete pipe, having a simple construction and improved to permit an easy parting of the mold, as well as easy assembling and positioning of the mold, thereby to overcome the above-described problems of the prior art.

It is another object of the invention to provide a mold which facilitates the production of mitred concrete pipe sections connected to each other at their mitred surfaces, while allowing an easy parting, assembling and positioning of the mold.

It is still another object of the invention to provide a mold for producing a concrete pipe, having a simple construction but suited to an easy production of concrete pipes of various curvatures and cross sections.

BRIEF DESCRIPTION OF THE DRAWINGS

FIGS. 6, 7, 8, 9, 10 and 11 are perspective views of a preferred embodiment of the mold showing the process of assembling the mold of the invention;

FIG. 12 is an elevational view of another form of concrete pipe;

FIG. 13 is a front elevational view of a second embodiment of the mold of the invention with the right half portion thereof in section;

DESCRIPTION OF THE PREFERRED EMBODIMENTS OF THE INVENTION

Figure 1:
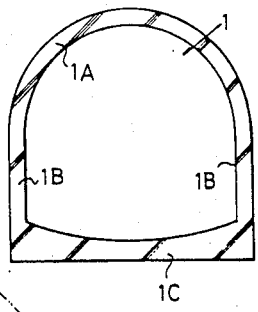
FIG. 1 is an elevational view in section of a concrete pipe.

As will be seen from FIG. 1, the sectional view of pipe 1 is a precast concrete product having an arch portion 1A, side portions 1B and a bottom portion 1C. This concrete portion 1 is produced by means of a mold comprising an arch-shaped inner mold part 2 and an arch-shaped outer mold part 3, with the axis of the pipe 1 aligned vertically.

The inner mold part 2 comprises an inner mold member 5 for the arch-shaped portion, a pair of substantially L-shaped inner side mold members 6, each flexibly connected to adjacent ends of the inner mold member 5 extending along the side portions 1B partially overlaying the bottom portion 1C, and a separable inner mold member 7 detachably connected between free ends of the inner side mold members 6.

Figure 2:
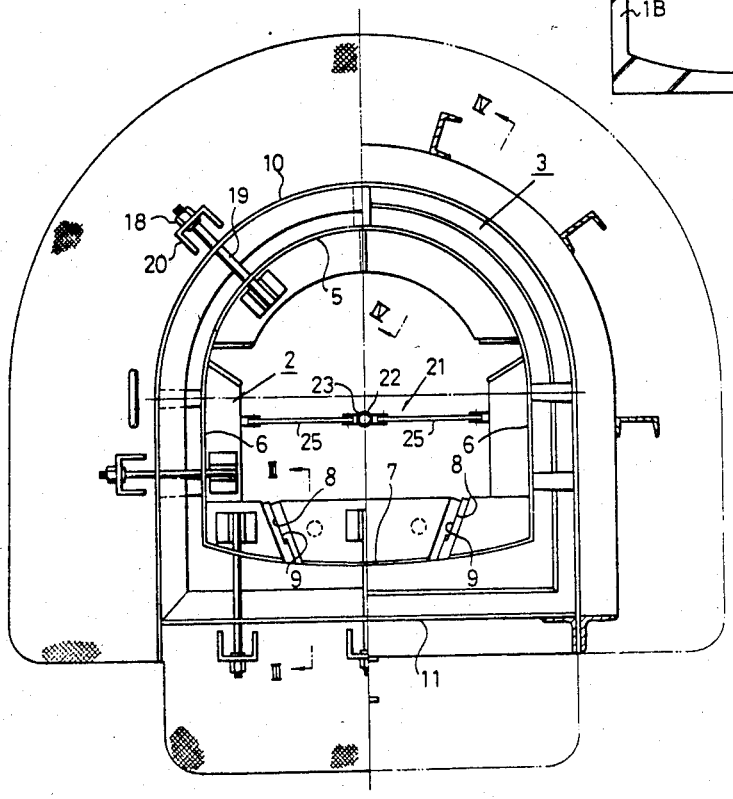
FIG. 2 is a plan view of a preferred embodiment of the mold of the invention, with the right half portion thereof being vertically sectioned behind the vertical plane of the left half portion.
Figure 5:
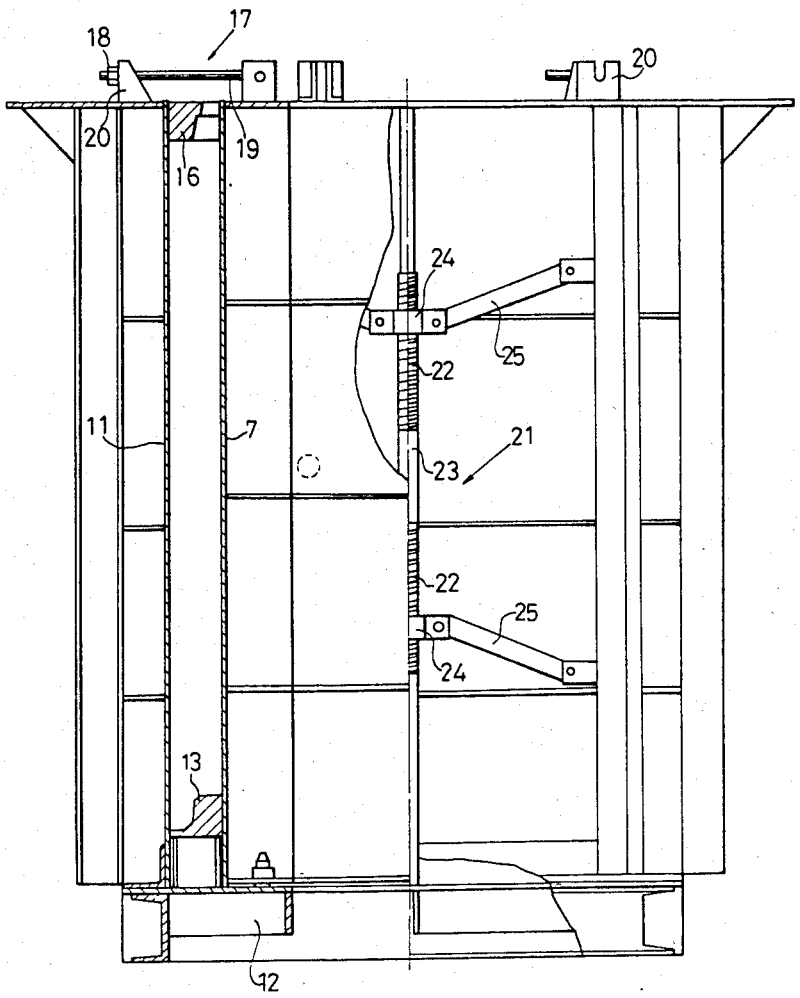
FIG. 5 is a side elevational view of the mold of the invention with the left half thereof partially sectioned.

The surfaces of the inner side mold members 6,6 opposed to each other are fastened to each other by a spacer 21, as shown in FIGS. 2 and 5. The spacer 21 permits the inner mold side members 6,6 to be shifted towards and away from each other when the mold is assembled and disassembled, and supports the inner side mold member 6 and 6 at the time of placement of the concrete.

As best shown in FIG. 5, the spacer 21 comprises a threaded rod member 23 with thread 22 standing upright from the substantially mid point of the inner mold part 2, a nut 24 engaging with the thread 22 so as to be moved up and down in accordance with the rotation of the rod member 23, and a link 25 which is pivotally secured at its one end to the nut 24 and connected at its other end to the portion of the inner mold side member 6 adjacent to the arch-shaped portion.

The separable inner mold member 7 has the form of a downwardly converging wedge-like shape with tapered engaging surfaces 8 formed on both end portions thereof. The tapered engaging surface 8 is adapted to be engaged by a tapered engaging surface 9 formed on the lower end of the inner mold side member 6.

The outer mold member 3 has a main outer mold member 10 which covers the arch-shaped portion 1A and the side portions 1B of the concrete pipe, and an auxiliary outer mold member 11 connected between opposing lower ends of the main outer mold member 10.

Figure 3:
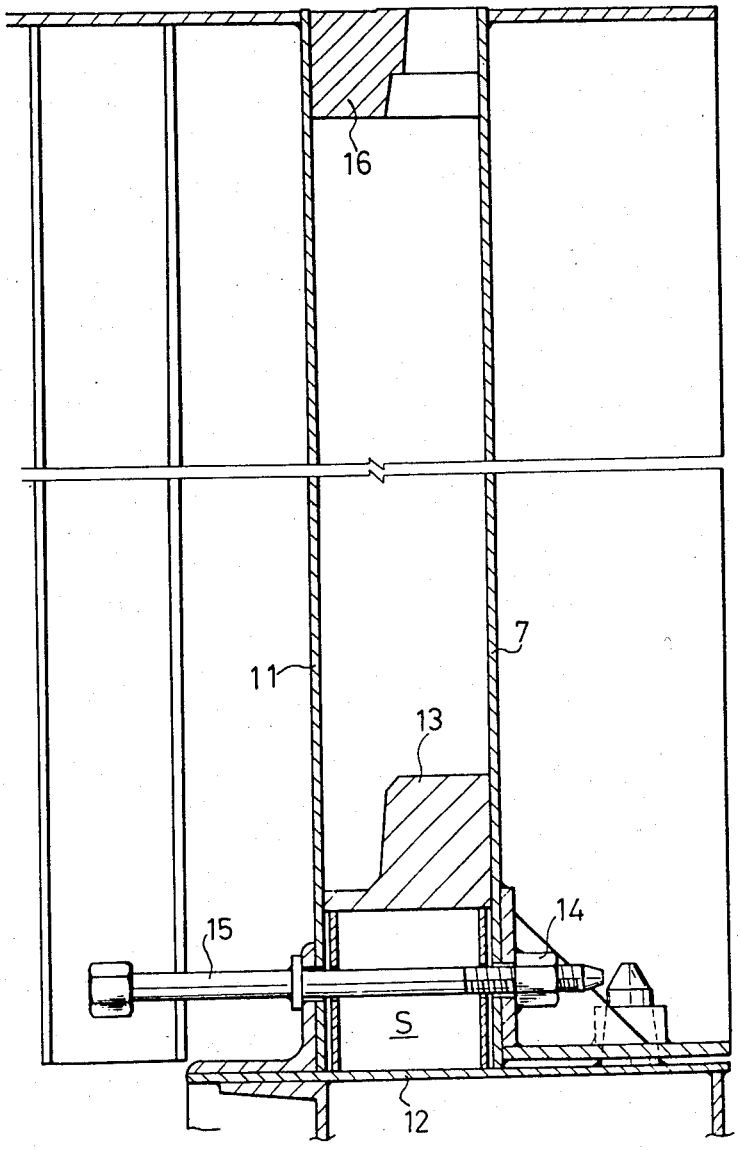
FIG. 3 is a sectional view taken along the line III—III of FIG. 2.
Figure 4:
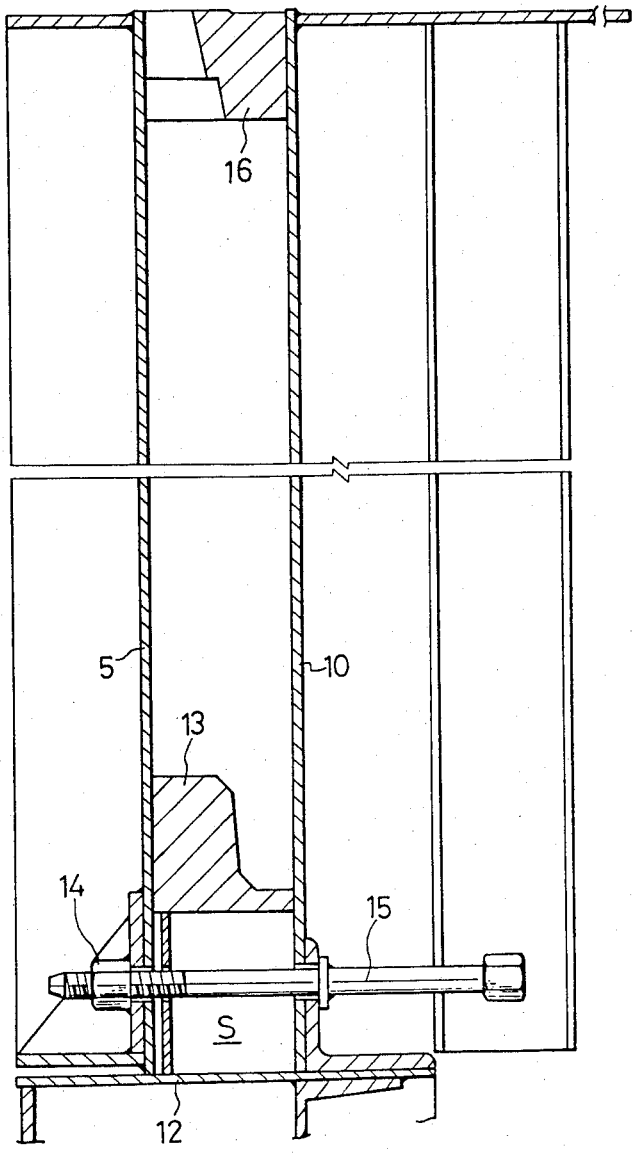
FIG. 4 is a sectional view taken along the line IV—IV of FIG. 2.

As will be seen from FIGS. 3 and 4, a pattern member 13 for forming an engaging rib around the opening of the concrete pipe is positioned above a bed 12 leaving a space S formed therebetween, and the inner mold members 5,6 and 7 and the outer mold members 10 and 11 are disposed so as to clamp the pattern member 13 therebetween. The inner mold members 5,6,7 and the outer mold members 10,11 are fastened together by means of a nut 14 fixed to a lower part of the inner mold part and a bolt which extends from the outer side of the outer mold part through the space S.

Another pattern 16 for forming an engaging rib around the open end of the concrete pipe is secured to the upper end of the outer mold members 10,11. As will be seen from FIGS. 2 and 5, the upper parts of the mold are connected through a connecting member 17 which is easy to mount and demount and capable of allowing free adjustment of the breadth. A nut 18 is screwed to the end of the connecting member 17. The connecting member 17 is composed of a connecting rod 19 having a base end pivotally secured to the upper surface of the inner mold members 5,6,7 so as to be able to swing vertically and carrying at its end a nut 18 fastened thereto, and a retaining member 20 secured to the upper surfaces of the outer mold members 10,11 and capable of retaining the nut 18.

Figure 6:
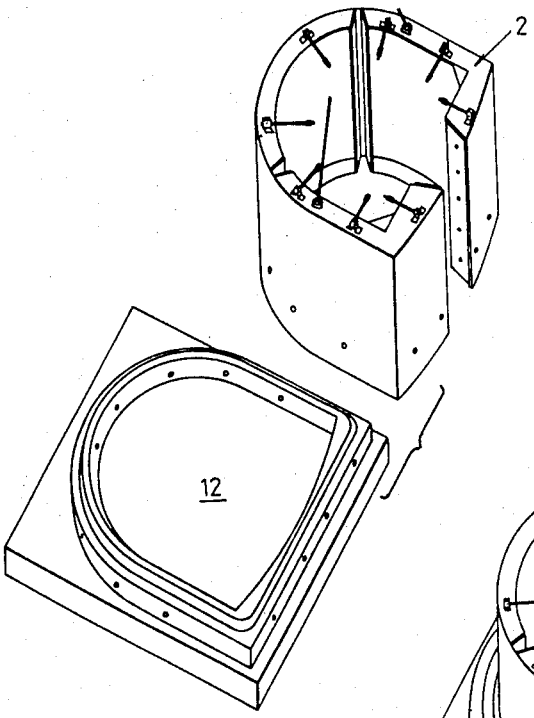
Figure 7:
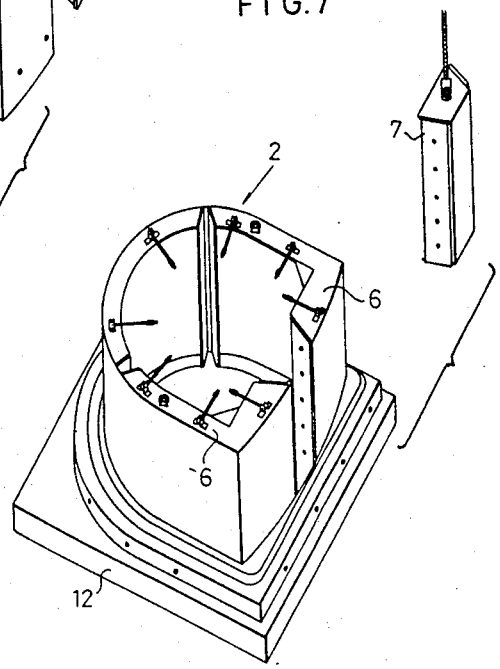

The assembling of the mold of this embodiment is conducted in the following manner. Namely, the inner frame part 2 in the contracted state, with the separable inner mold member 7 removed therefrom, FIG. 6, is placed on the base 12 as shown in FIG. 7. Then, the inner mold part 2 is expanded and the separable inner mold member 7 is inserted (see FIG. 7) and secured to the free ends of the inner mold side members 6. Subsequently, reinforcing steel means (not shown) are set in place.

Figure 10:
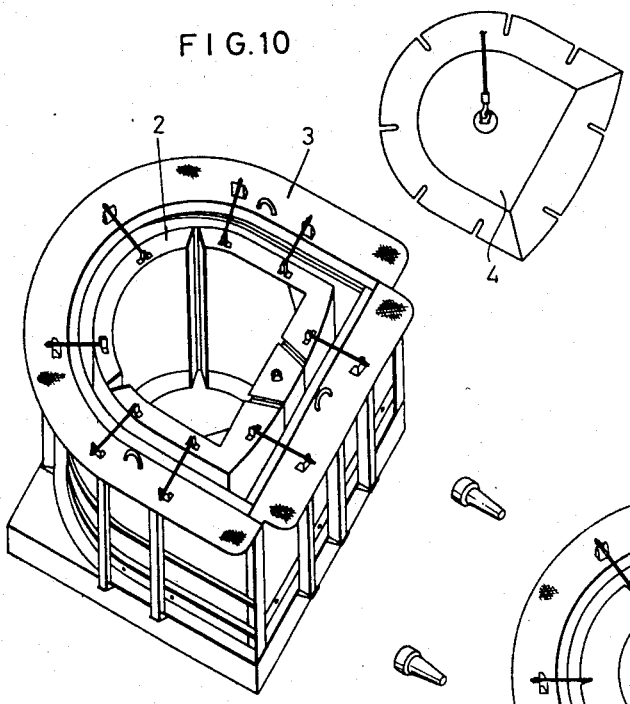
Figure 11:
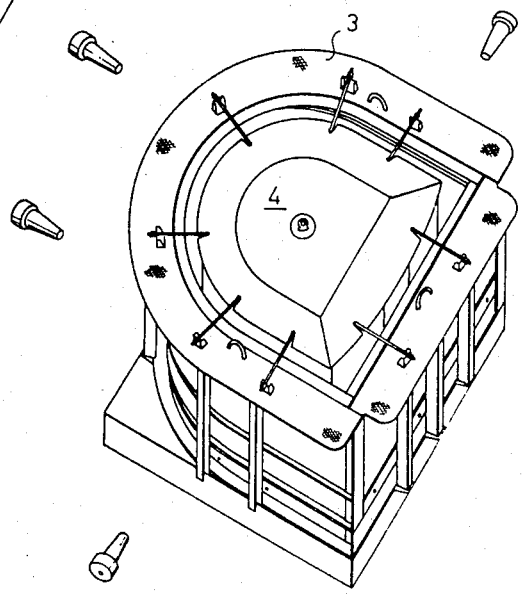

Thereafter, the upper outer mold member 10 and the lower outer mold member 11 are secured as shown in FIGS. 8 and 9; the inner mold part 2 and the outer mold part 3 are connected to each other; and a cover 4 is attached to close the opening of the inner mold member 2 (see FIGS. 10, 11).

For parting the mold from the product, the inner mold part 2 and the outer mold part 3 are disconnected from each other; the outer mold part 3 is detached from the concrete product; the separable inner mold member 7 is detached and the inner mold side members 6,6 are swung inwardly so that the inner mold part 2 can be easily detached from the concrete product. Although a first embodiment has been described with reference to the production of the horseshoe-shaped precast concrete pipe product, this embodiment can be applied equally to precast concrete pipe product which has a rectangular outer configuration and a horseshoe-shaped internal cavity as shown in FIG. 12, by replacing the outer mold part 3.

Figure 14:
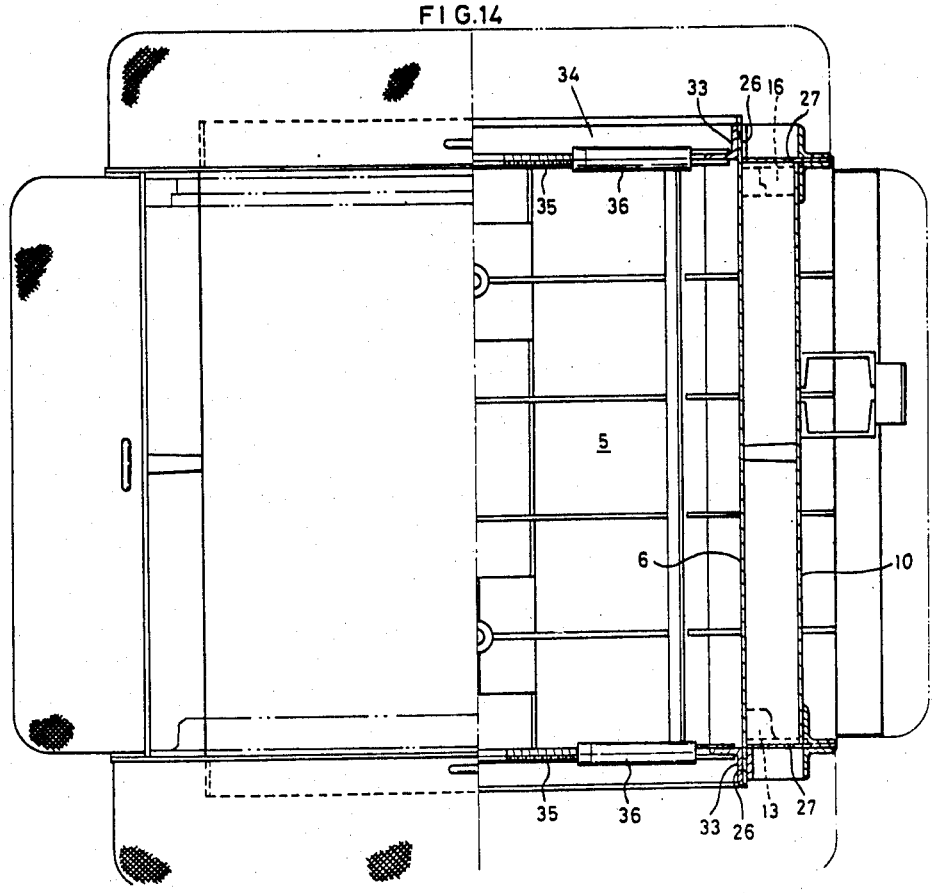
FIG. 14 is a plan view of a similar mold with the right half portion in section.
Figure 15:
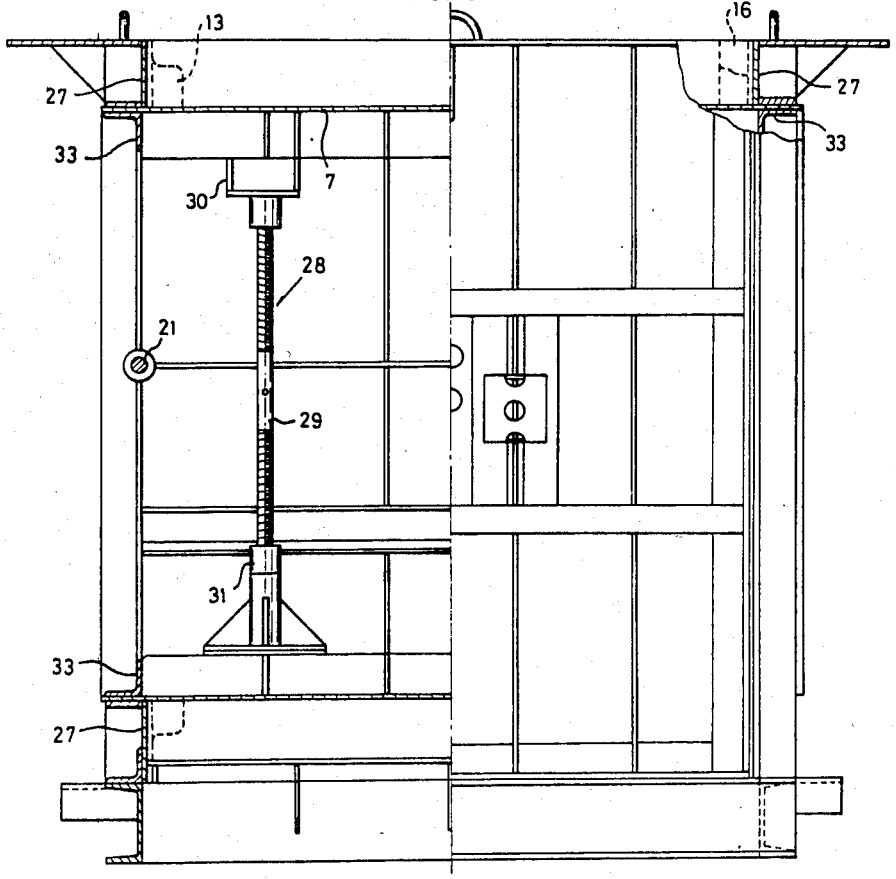
FIG. 15 is a side elevational view of a similar mold with the left half portion thereof in section.

FIGS. 13 to 15 show another embodiment of the invention comprising a horseshoe-shaped inner mold part 2 and a horseshoe-shaped outer mold 3 adapted to produce the concrete pipe 1 with its arch-shaped portion directed downwardly.

The inner mold member 2 comprises an inner mold member 5 for forming the arch-shaped portion and a pair of substantially L-shaped inner mold side members 6 pivotally connected at their ends to adjacent ends of the inner mold member 5. Side members 6 are spaced from and extend substantially parallel to the side portions 1B and bottom portion 1C. A separable inner mold member 7 is detachably connected between the free ends of the inner mold side members 6. The separable inner mold member 7 is provided at its both ends with inwardly tapered engaging surfaces 8. Tapered engaging surfaces 9 for engaging the tapered engaging surfaces 8 are formed on the free ends of the inner mold side members 6.

The outer mold part 3 is comprised of an outer mold sheath member 10 which encloses the arch-shaped portion 1A and both side portions 1B. The upper surface 1D, parallel to and spaced above portion 1C, is left uncovered.

Both end openings defined between the inner mold part 2 and the outer mold part 3 are closed by partition plates 27. Pattern members 13 and 16 for forming engaging ribs and engaging grooves around the openings of the concrete pipe are secured to the inner surfaces of the partition plates 27.

The inner mold member 5 for the arch-shaped portion and the separable inner mold member 7 are held in place with double-acting screw jack 28 which permits a vertical adjustment of the separable inner mold member 7.

The screw jack includes a rod 29 having a right-hand thread and a left-hand thread, and mounting members 30,21 secured to opposite ends of the rod 29. The mounting members 30 and 31 are secured to the rear surface of the separable inner mold member 7 and to the mid portion of the arch-shaped inner mold member 5, respectively. The arrangement is such that the separable inner mold member 7 is connected to and disconnected from the inner mold side members 6 as the screw rod 29 is rotated.

Supporting members 32 for holding the shape of the inner mold part 2 are secured to the opposite open ends of the inner mold part 2. The supporting member 32 is composed of a ring-shaped frame 33 having a configuration corresponding to that of the inner mold part 2, and a connecting member 34 which extends horizontally, as shown in FIG. 13, and supports the frame 33 at its mid section. The connecting member 34 is composed of a threaded rod 35 having a right-hand thread and a left-hand thread, and mounting members 36,36 secured to both ends of the screw rod 35. The mounting members are secured to the frame members 33 so that the distance can be adjusted by rotating the rod 35 in turnbuckle fashion.

According to this embodiment, in order to separate the mold from the product, the supporting members 32 and the partition plates 27 are removed; the threaded rod 29 is rotated to lower the separable inner mold member 7, and the inner mold side members 6 are pivoted inwardly. By so doing, it is possible to easily separate the mold from the product.

The mold can be assembled by reversing the procedure for parting the mold. The inner mold part 2 can be located and fixed rigidly, correctly and easily by use of the connecting members 34 and the supporting members 32. Although this embodiment of the invention has been described with specific reference to the standard horseshoe-shaped precast concrete product, it can also be used for the production of a precast concrete product having a rectangular outer configuration and horseshoe-shaped internal cavity.

Figure 16:
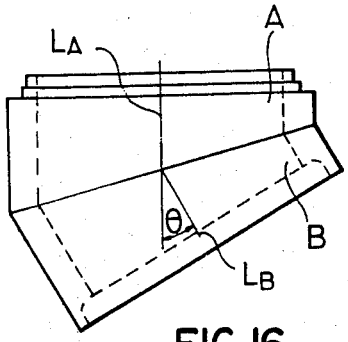
FIG. 16 is a front elevational view of a concrete pipe elbow.

FIGS. 16 to 21 show still another embodiment of the mold of the invention. This mold is intended for the production of a concrete elbow comprising a first mitred precast concrete portion A having an arch-shaped portion a, straight side portions b and a flat bottom portion c. A second mitred portion B is cast integral with portion A along a mitre line M inclined to the horizontal at an angle $\theta$ as shown in FIG. 16.

Figure 17:
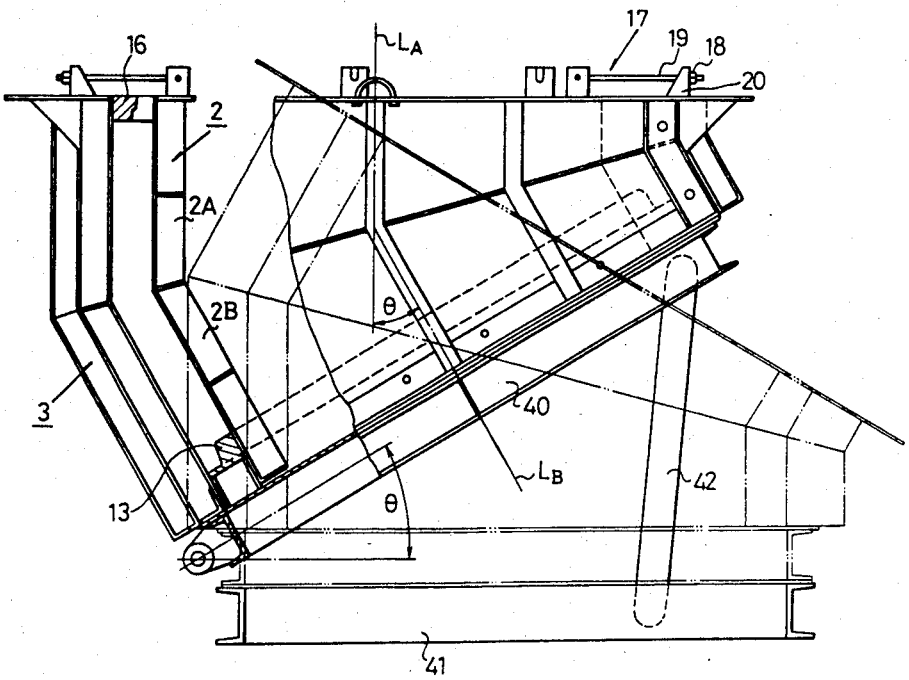
FIG. 17 is a partly sectioned front elevational view of a mold for producing the concrete pipe elbow of FIG. 16.
Figure 18:
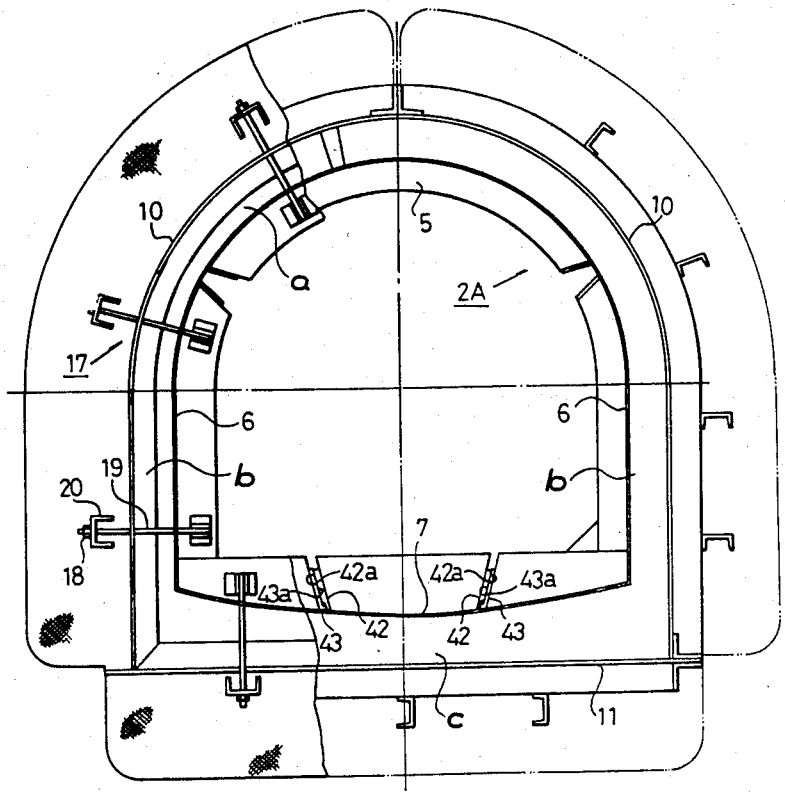
FIG. 18 is a partly sectioned plan view of the mold of FIG. 17.
Figure 19:
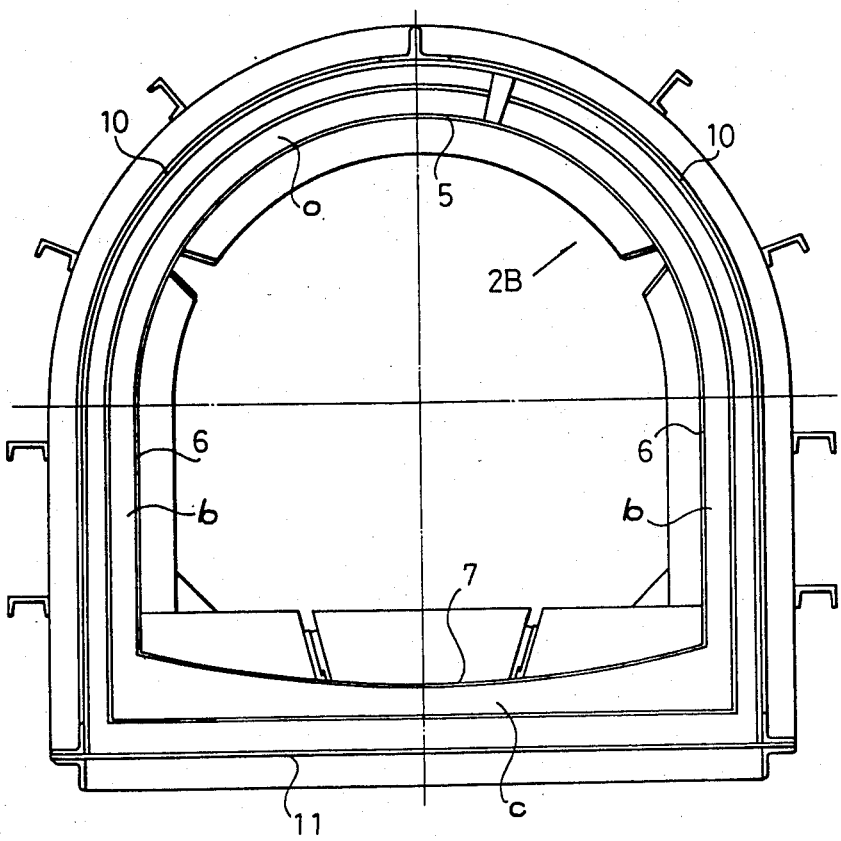
FIG. 19 is a plan view of the mold of FIG. 17.
Figure 20:
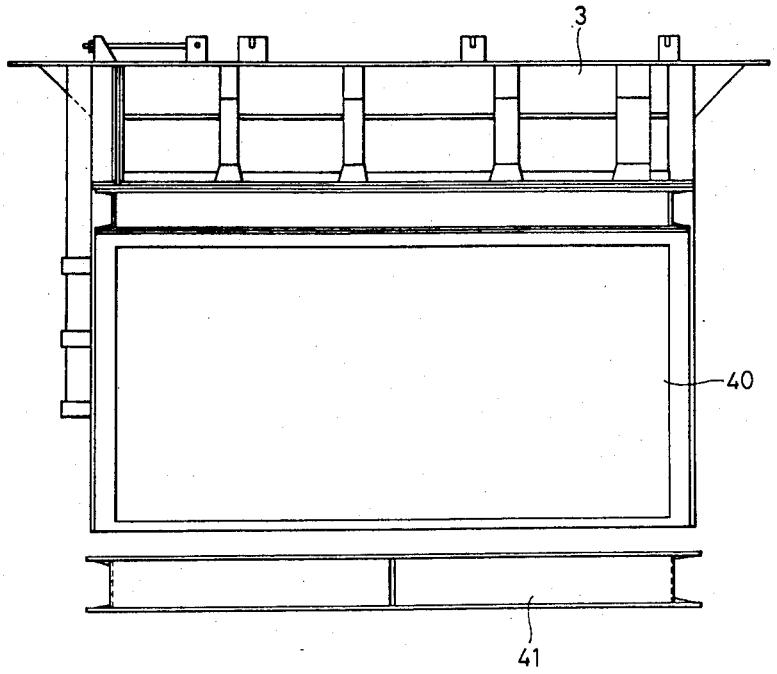
FIG. 20 is a side elevational view of the mold of FIG. 17.

As shown in FIGS. 17 to 19, the mold is composed of an inner mold part 2 having an arched cross section 5 for defining the internal cavity of the one mitred portion and an outer mold part 3 also having an arched cross-section for defining the outer configuration of the same.

More specifically, the inner mold part 2, FIG. 17, comprises an upper inner mold section 2A and a lower mold part section 2B which are detachably connected to each other at their adjacent ends. Mold section 2B is secured at its lower portion to a base 40. The base 40 is connected at its one end to a horizontal support 41 for arcuate motion over an angle $\theta$ between a first position in which the axis $L_A$ of the upper inclined pipe A extends vertically and a second position in which the axis $L_B$ of the lower inclined pipe extends vertically. The first position is determined by a supporting link 42, while the second position is determined by removing the supporting link 42 to place the base 40 on the support 41.

A detailed description will be made hereinunder, in conjunction with FIG. 18, as to the cross-sectional shapes of the inner mold parts 2 and the outer mold parts 3, which are the same for both upper and lower mold sections 2A and 2B, respectively.

Each of the inner mold part sections 2A,2B has an arch-shaped inner mold member 5, a pair of substantially L-shaped inner mold side members 6 flexibly connected to opposite ends of the inner mold member 5 to provide side portions and partial bottom portions of the inner mold, and a separable inner mold member 7 detachably connected between the free ends of the inner mold side members 6. Guide rails 42 having tapered engaging surface 42*a* are fixed to both end portions of the separable inner mold member 7. Guide rails 43, having tapered engaging surfaces 43*a* for engagement with the tapered engaging surfaces 42*a*, are secured to the free ends of the inner mold side members 6.

The outer mold part 3, FIG. 19, is composed of two main outer members 10,10 covering the arch-shaped portion and the side portions, and an auxiliary outer mold member 11 bridging the lower portions of mold members 10,10 so as to form a bottom for the outer mold 3.

Figure 21:
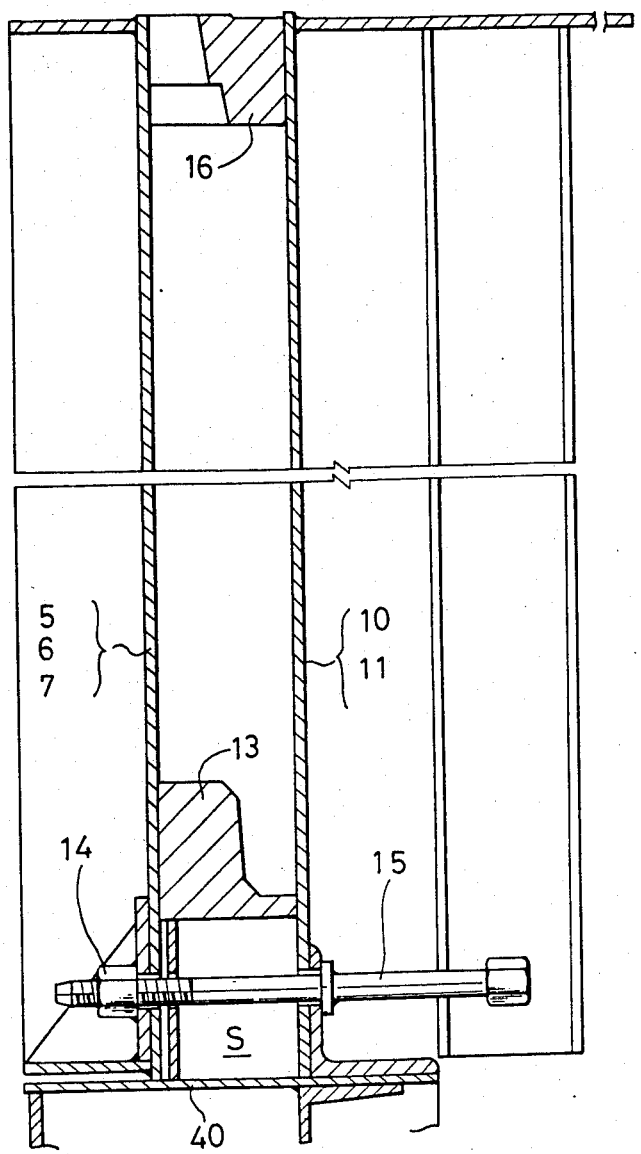
FIG. 21 is a partial vertical sectional view of the mold of FIG. 17.
Figure 22:
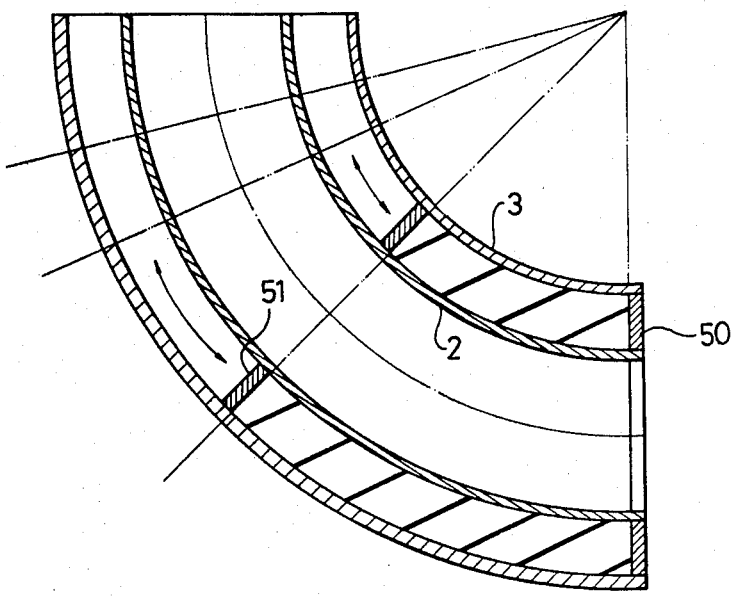
FIG. 22 is a schematic vertical sectional view of a mold of the invention suitable for use in the production of a concrete pipe elbow.

As will be seen from FIGS. 17 and 21, a pattern member 13 for forming an engaging rib around the open end of the concrete pipe is placed above the base 40 to leave a space S. The inner mold members 5,6,7 and the outer mold members 10,11 for the lower inclined pipe B are disposed to clamp the pattern member 13 therebetween. The inner mold members 5,6,7 and the outer mold members 10,11 are assembled together by means of a nut 14 fixed to a lower portion of the inner mold part and a bolt 15 which extends from the outer side of the outer mold through the space S.

Another pattern member for forming an engaging groove around the open end of the concrete pipe is secured to the upper end of the outer mold members 10 and 11. As will be seen from FIGS. 17 and 18, the upper parts of the mold are connected by means of connecting members 17 which can be detached easily and which permits an easy adjustment of breadth. Each connecting member is composed of a connecting rod 19 swingably attached at its one end to the upper surface of the inner mold part 5,6 or 7 for vertical swinging motion. A nut 18 is screwed to the free end of rod 19 and retaining members 20 are secured to the upper surfaces of the outer mold parts 10 and 11 and are capable of providing bearing surfaces for nuts 18.

The assembling of the mold is commenced from the outside position illustrated by two dot-and-dash lines in FIG. 17. With the separable inner mold part 7 removed, the inner mold part section 2B for the lower inclined pipe is contracted inwardly and placed on base 40. Thereafter, the inner mold part section 2B is expanded and the separable inner mold member 7 is lifted and connected to the free ends of the inner mold side members 6 by means of bolts or tapered pins. Subsequently, reinforcement rods (not shown) are set in place and then a preassembled inner mold part section 2A for the upper inclined pipe is connected to the inner mold part section 2B for the lower inclined pipe.

Subsequently, the main outer mold members 10,10 and the auxiliary outer mold part 11 are assembled together, and the outer mold part 3 is connected to the inner mold part section 2A for the upper inclined pipe. After completing the assembling in the described manner, the base 40 is rotated by an angle $\theta$ to the position in which the pipe axis $L_A$ extends vertically. The mold is then fixed in this position and the concrete is poured.

For parting the mold from the product, the outer mold part 3 is disconnected from the inner mold part section 2A for the upper inclined pipe, and is separated from the concrete product. Subsequently, the separable inner mold member 7 of the inner mold part section 2A for the upper inclined pipe section is detached and the inner mold side members 6,6 are swung inwardly. The inner mold part 2A is then parted from the concrete product.

Subsequently, the concrete product remaining on the inner mold part section 2B for the lower inclined pipe is swung together with the latter by an angle $\theta$ to the position illustrated by two dot-and-dash lines in FIG. 17. In this state, it is possible to lift the concrete product away from the inner mold part section 2B.

Although this embodiment has been described with reference to a standard horseshoe-shaped precast concrete pipe, it will be clear to those skilled in the art that this embodiment can be applied equally to the production of a horseshoe precast concrete product having a rectangular outer configuration and a horseshoe-shaped internal cavity, simply by changing the configuration of the outer mold part 3. Mitred concrete pipes having any other cross-sectional shape can be produced by the mold of this embodiment, by using matching mold parts for the required cross-sectional shape of the product.

FIGS. 22 to 30 show a further embodiment of the mold of the invention for producing a curved concrete pipe C which is formed with a constant radius R. In this mold, the inner mold part 2 and the outer mold part 3 are formed at the desired curvature. The open ends formed between these mold parts 2 and 3 are closed by partition plates 50 and 51. A partition plate 4 may be moved to any desired position along the curve to form a concrete pipe of desired angular length.

Figure 23:
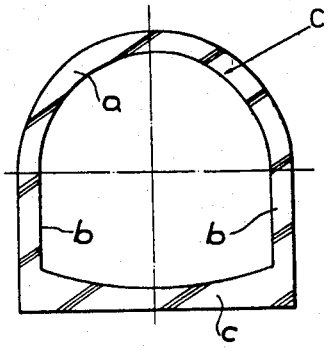
FIG. 23 is a vertical sectional view of an arch-shaped concrete pipe.

An example of this embodiment, suitable for the production of a constant radius curved pipe C having horseshoe-shaped cross-section constituted by an arch-shaped portion [α] a, side portions [β] b and the bottom portion [γ] c as shown in FIG. 23 will be explained hereinunder.

Figure 24:
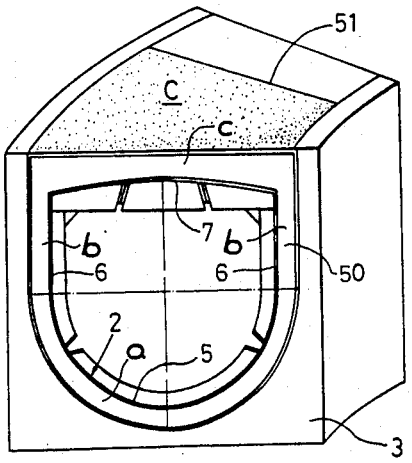
FIG. 24 is a schematic perspective view of a mold for producing the concrete pipe shown in FIG. 23.
Figure 25:
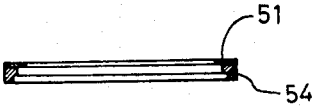
FIGS. 25 and 26 are sectional views showing partition plates incorporated in the mold shown in FIG. 24.
Figure 26:
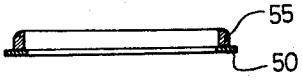

As will be seen from FIG. 24, this curved concrete pipe C is formed in an inverted posture. More specifically, the outer mold part 3 has a form to cover the arch-shaped portion a and the side portions b. The upper end of the outer mold part 3 is left uncovered.

The inner mold part 2 is constituted by an inner mold member 5 for the arch-shaped portion, a pair of substantially L-shaped inner side mold members 6 swingably connected to both ends of the inner frame member 5 and extending over the side portions b to parts of the bottom portion c, and a separable inner mold member 7 detachably connected between free ends of the inner side mold members 6.

According to this arrangement, the mold can be parted easily by swinging the pair of inner mold side members 6 inwardly after removing the separable inner mold member 7.

The partition plates 50 and 51 have configurations corresponding to the horizontal open ends formed between the inner mold part 2 and the outer mold part 3. Pattern members 54 and 55 for forming the engaging ridge 52 and the engaging groove 53 around the open ends of the bent pipe C are secured to the inner surfaces of the partition plates 50 and 51. Preferably, the inner frame part 2 has a length which is equal to the length of the curved pipe C to be produced.

Figure 27:
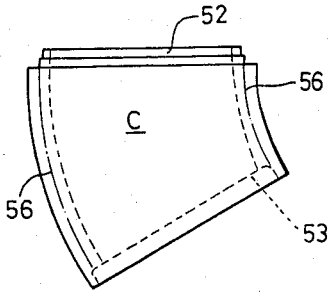
FIG. 27 is a plan view of a concrete pipe elbow produced by the mold shown in FIG. 24.
Figure 28:
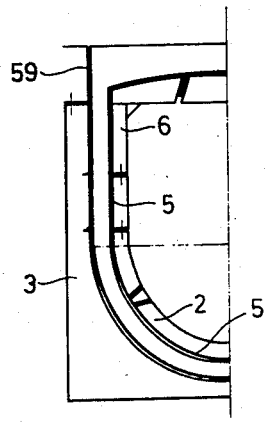
FIG. 28 is a partial elevational view of a modification of the mold shown in FIG. 24.

In the production of the bent concrete pipe C, a steel cage is set on the outer mold part 3 and, after mounting the inner mold part 2 and the partition plates 50 and 51, the concrete is placed in the mold. The parting of the mold can be made easily by lifting the curved pipe C after the removal of the inner mold part 2. Since the curved pipe C has a constant radius as shown in FIG. 27, PC steel bars may be easily inserted by using a sheath 56 of a curvature corresponding to the curvature of the pipe C.

The vertical cross-sectional dimension of the curved pipe C can be increased as desired, by adding a linear plate 57 to each inner mold side member 6 and adding similar plates 58 to the upper ends of the outer mold part 3.

Figure 29:
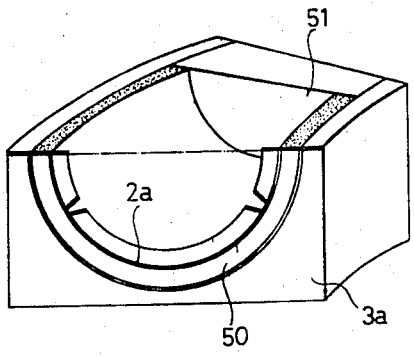
FIGS. 29 and 30 are perspective views of split-type molds.
Figure 30:
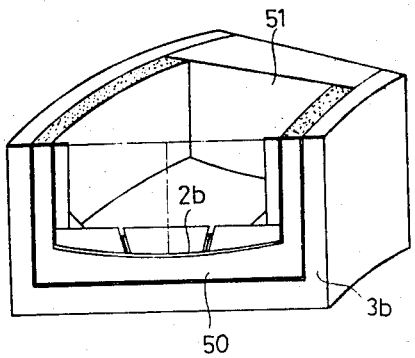

As shown in FIGS. 29 and 30, in case that the curved pipe C is of horizontally split type, halves of the pipe are produced separately by mold halves one of which is composed of an inner mold part section 2A and an outer mold part section 3*a*, while the other is composed of an inner mold part section 2*b* and an outer mold part section 3*b*. If the pipe has a cross-section which is symmetrical with respect to a horizontal plane, it is not necessary to prepare two mold halves. Namely, in such a case, the halves of the product pipe can be fabricated by repetitionally using a half mold composed of one inner mold part section and one outer mold part section.

Figure 31:
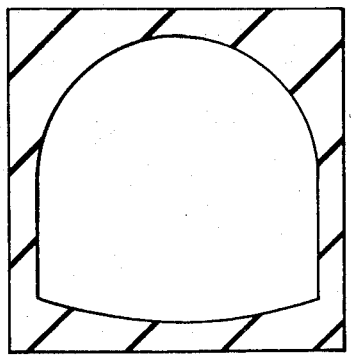
FIGS. 31, 32, and 33 are cross-sectional views of various forms of concrete pipes which can be made by preferred embodiments of the invention.
Figure 32:
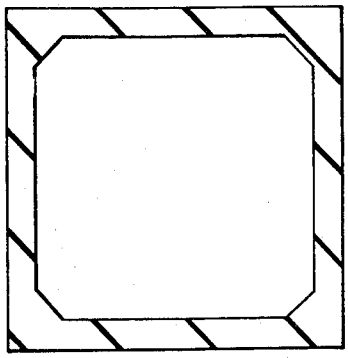
Figure 33:
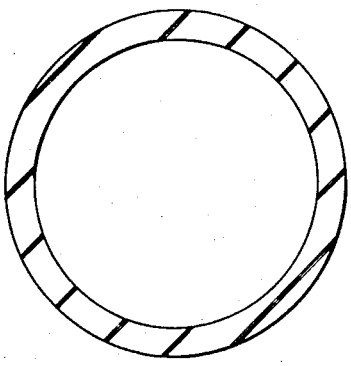

Although the preferred embodiment of the invention has been described with specific reference to an ordinary pipe having a horseshoe-shaped cross-section, it will be clear to those skilled in the art that the invention is equally applicable to curved pipes having other cross-sectional shapes, such as rectangular cross-sections with horseshoe-shaped internal cavities (see FIG. 31), square shapes (see FIG. 32) and circular shapes (see FIG. 33).

As will be clearly seen from the foregoing description of preferred embodiments of the invention, the present invention offers the following advantages.

According to the invention, the inner mold is comprised of an upper arch-shaped mold member, a pair of substantially L-shaped inner side mold members swingably connected to both ends of the upper arch-shaped mold member to extend over the side portions of the mold to parts of the bottom portion, and a separable inner mold member detachably connected between free ends of the inner side mold members. With this arrangement of mold members, the parting of the inner mold and the assembling and positioning of the mold members are very much facilitated.

In regard to the production of a curved concrete pipe comprising pipe portions forming an angle $\theta$, the mold is arranged to produce the pipe with the axes of these pipes disposed alternately substantially vertically. The inner mold part is divided into a section for the upper inclined pipe and a section for the lower inclined pipe. The mold in such case can be fixed at a position in which the axis of the upper inclined pipe extends vertically and then shifted to a position in which the axis of the lower inclined pipe extends vertically. Consequently, the parting of the mold from the product can be facilitated advantageously with quite a simple construction.

In regard to the production of a curved pipe, the inner and outer mold parts are curved on concentric curvatures and the openings of the space between these mold parts are closed at any desired positions by means of partition plates. Consequently, curved concrete pipes of various radii can be easily produced in a very efficient manner.

What is claimed is:

1. A two-piece mitred mold for producing a concrete pipe elbow, each piece comprising: an outer face normal to its longitudinal axis and an inner face inclined to its longitudinal axis; a two-member outer part and a four-member inner part, said outer part including a member defining the bottom of the outer part and a unitary upper member defining the sides and top of the outer part, said parts being rigidly secured one to the other; said inner part including a top member; a pair of L-shaped side members having vertical leg portions defining the sides of the inner part, and lower horizontal leg portions directed inwardly toward each other and spaced apart to partially define the bottom of the inner part; a bottom member adapted to be removably wedged between the inwardly directed horizontal legs of said L-shaped side members; the upper ends of said L-shaped members being flexibly secured to the opposite ends of said top member; quick release clamp means secured to the opposite ends of one of said parts for releasable attachment to the other of said parts; said clamp means being adapted to rigidly space said inner part from said outer part to define therebetween the configuration of the concrete pipe to be molded by said mold, and end plates to contain the concrete between said inner and outer parts while hardening, said inner faces of said pieces being adapted to interface to form said two-piece mitred mold; a base secured to the outer face of one of said pieces; a horizontal support pivotally secured to said base; means to pivot said base to an inclined position to vertically align the axis of said one of said pieces; and means to pivot said base to a horizontal position to vertically align the axis of the other of said pieces, whereby said concrete pipe is poured when said one of said pieces is in the inclined position and whereby said inner parts are thereafter removable from said outer parts by releasing said clamps, removing said bottom members from between said L-shaped side members and flexing said L-shaped members inwardly.

2. The device of claim 1, wherein said one of said pieces is pivotally adjustable between the horizontal and inclined positions by the selective interposition of a detent between said base and said horizontal support.

* * * * *